United States Patent [19]

Botsch

[11] Patent Number: 5,016,330

[45] Date of Patent: May 21, 1991

[54] PERSONALIZED PET ANIMAL MEMORIAL PRODUCT

[76] Inventor: Susan Botsch, Rte. 4, P.O. Box 294, Dexter, Mo. 63841

[21] Appl. No.: 497,777

[22] Filed: Mar. 21, 1990

Related U.S. Application Data

[62] Division of Ser. No. 390,091, Aug. 7, 1989, abandoned.

[51] Int. Cl.[5] ..... A61G 17/00

[52] U.S. Cl. ..... 27/1; 264/62

[58] Field of Search ..... 27/1; 264/62

[56] References Cited

U.S. PATENT DOCUMENTS 1,640,680 8/1927 Vanderlaan ..... 264/62

*Primary Examiner*—Richard E. Chilcot, Jr.

*Attorney, Agent, or Firm*—Neil F. Markva

[57] ABSTRACT

A method of memorializing a living being produces an inscribed image having a shaped surface. The method comprises cremating the expired remains of a living being to produce a resultant particulate ash product. A mixture of moldable materials is prepared and adapted for forming a molded object. At least a portion of the resultant particulate ash product is blended with the mixture of particulate moldable materials to produce a moldable product. The moldable product is then formed as an image having a shaped surface. The shaped image is processed to produce a rigid object consisting of permanently bonded particulate ash product and moldable materials. The shaped surface is then inscribed with indicia descriptive of the identity of the living being from which the resultant ash product has been obtained. In a specific embodiment, the living being is an animal such as a dog, a cat, a bird and the like.

1 Claim, No Drawings

PERSONALIZED PET ANIMAL MEMORIAL PRODUCT

This is a division of application Ser. No. 390,091, filed Aug. 7, 1989, now abandoned.

FIELD OF THE INVENTION

This invention relates to perpetuating the remembrance of a living being. More particularly, this invention relates to producing a shaped image in memory of a living being such as a human being or a animal.

BACKGROUND OF THE INVENTION

The memorializing of deceased living beings is part of our cultural heritage. Methods for holding the cremated remains of deceased living beings include various types of urns which receive the ashes of the dead. This includes receptacles formed in the shape of a statue, bust or other part of the human figure provided with a recess at the back, head, or other suitable part adapted to be closed by a cover. The recess is a receptacle for the cremated remains. U.S. Pat. No. 232,782 issued Sept. 28, 1880 typifies such an early urn. U.S. Pat. Nos. 2,009,724; 2,562,726 and 3,167,844 exemplify other various types of receptacles for the ashes of the deceased.

Various types of indicia disclosing descriptive material related to the deceased living being are found on some of these early urns. Attachments as found in U.S. Pat. No. 2,835,014 are useful in memorializing the deceased by inscribing indicia onto a casket, vault or the container for the cremation ash product. U.S. Pat. No. 1,940,771 shows a particular type of burial urn having descriptive material concerning the deceased and integrally formed with the urn.

U.S. Pat. No. 4,324,026 discloses a cremation urn in which the cremated remains of the deceased are placed. The urn structure also includes a readily accessible compartment for holding various memorabilia associated with the deceased.

U.S. Pat. No. 1,434,182 discloses a built-up monument usable in a memorial cemetery. Moldable materials known at the time were available to produce the disclosed object. It is not uncommon to have various types of statues made of the deceased as a particular memorial to the individual. Such statues appear throughout our land as specific memorials to those individuals.

Additionally, other types of memorial images and shaped objects are used to perpetuate the memory of loved ones. For example, the medallion in U.S. Pat. No. 4,222,189 includes an embossed or carved face or bust image of a human being surrounded by a decoration portion of the medallion. Such an object may be cast or injection molded.

Although the uses of creation urns, monuments and memorial devices are known as described, none of the prior art configurations constitute a personalized memorial such as in the present invention.

PURPOSE OF THE INVENTION

The primary object of the invention is to provide a method of memorializing a living being using the actual particulate ash product of the deceased in the construction of a shaped image.

A further object of the invention is to memorialize a living being such as an animal including a dog, a cat, a bird or other pet having its cremated remains used as an integral part of the shaped image.

These objects are accomplished through the method of memorializing a deceased living being in accordance with the invention.

SUMMARY OF THE INVENTION

The method of the invention comprises cremating the expired remains of a living being to produce a resultant particulate ash product. A mixture of particulate moldable materials adapted for forming a molded object is prepared. At least a portion of the particulate ash product from the cremation process is blended with the mixture of particulate moldable materials to produce a moldable product. The moldable product is then shaped to form an image having a shaped surface. The shaped image is processed in whatever manner required to produce a rigid object consisting of permanently bonded particulate ash product and moldable materials. The shaped surface is then inscribed with indicia descriptive of the identity of the living being.

The method of the invention is particularly suitable for memorializing pets such as dogs, cats, birds, and the like. Once having produced a resultant particulate ash product by cremating the expired remains of the deceased pet, either all or a portion of that ash product is blended with a mixture of particulate moldable materials to produce a moldable product.

The mixture of particulate moldable materials may be either wet or dry depending upon the image structure desired. In a specific embodiment, the image formed with the moldable product incorporating the particulate ash product is in a shape corresponding to the shape of the living being from which the ash product has been obtained in the cremating step.

Depending upon the particular type of particulate moldable material mixture, the particulate ash product may be used as it results directly from the cremation process. However, it may be necessary to subject the ash product to a pulverizing step to reduce the particles to a size sufficient to be adequately and compatibly blended into the mixture t form the desired moldable product.

Any type of shaping process may be used to form the desired image including various known manual shaping operations. Once formed, the shaped image may be subjected to further processing to produce a permanently bonded particulate ash product and moldable materials.

The shaping step may include providing a mold device having a mold cavity with a predetermined shape. The moldable product is then introduced into the cavity to produce the shaped surface of the image being formed. Once removed, the resultant shaped image may require further processing to produce a permanent bonding of the particles within the shaped product.

Alternatively, the shaping step may include pressing the moldable product to form the image and then sintering the image so formed to produce the permanently bonded particulate ash product and moldable materials. When the living being is a pet animal such as a dog, cat, or bird, the image is formed in the shape of that animal and then may be inscribed with indicia that includes duplication of body markings of that animal. The indicia may also include documentation of facts relating to the animal.

In another embodiment, the particulate ash product from the cremated remains of the deceased living being may be formed into a molded shape or object representing something for which the deceased was particularly noted. This might include a replica of that living being's house, automobile, or other favorite item of memorabilia.

DETAILED DESCRIPTION

The product of the invention is an inscribed image having a shaped surface made by the process of the invention. The cremated ash product of the living being is incorporated into a ceramic, plaster, porcelain, concrete or plastic moldable material useful for producing many different types of statuary or shaped objects.

If the memorial object is formed of ceramic or porcelain, the bonding of the particles is made permanent via known firing techniques depending upon the particular moldable materials being used. Plaster and cement products may require a simple ambient air drying step to produce the final memorial object. Numerous plastic processes are available to produce the rigid shaped object containing particles of the cremation ash product.

The first step of the process according to the invention is that of cremating the expired remains of a living being to produce a resultant particulate ash product. U.S. Pat. No. 3,837,301 typifies the kind of apparatus usable for preparing cremated ashes such as those used in accordance with this invention. U.S. Pat. No. 3,837,301 is incorporated herein in its entirety by reference to disclose a method for cremating the expired remains of a deceased living being.

The second step of the method of the invention is preparing a mixture of particulate moldable materials adapted for forming a molded object. Virtually any type of molding material may be used to form the molded product in accordance with this invention. This includes such processes as forming artificial stones or marble taught in U.S. Pat. Nos. 1,948,079 and 1,964,088, respectively; a process for making building blocks as found in U.S. Pat. Nos. 2,527,766; 4,120,735; and 4,659,385; a method of making shaped images from lightweight aggregate as disclosed in U.S. Pat. Nos. 3,973,973 and 4,701,222; a process for forming a shaped ceramic product as found in U.S. Pat. No. 3,679,441; or a method of making a durable mass as taught in U.S. Pat. No. 4,432,800. U.S. Pat. Nos. 1,948,079; 1,964,088; 2,527,766; 3,679,441; 3,973,973; 4,120,735; 4,432,800; 4,659,385 and 4,701,222 are incorporated herein in their entirety by reference with the understanding that a portion of the mixtures include an amount of particulate ash product sufficient to produce a moldable product for forming a shaped image consisting of permanently bonded particulate ash product and moldable materials.

The particular molding material to be used may depend upon the desired location for displaying the molded and/or shaped image. This may include cementatious types of molded material for yard statuary as found in U.S. Pat. No. 1,948,079 or fine bone china creations such as disclosed in U.S. Pat. No. 4,219,360. A method for making a wet mixture of moldable material may be used in accordance with U.S. Pat. No. 3,886,244 wherein bricks are produced from red mud. U.S. Pat. No. 4,640,715 discloses a moldable material to form a dry moldable mixture including a mineral binder, kaolin and silica, fly ash and calcined clay. U.S. Pat. No. 3,978,180 discloses a method of producing a noncombustible molding material. A portion of the cremated expired remains of the living being is included in this moldable material to form a desired molded image. U.S. Pat. Nos. 3,886,244; 3,978,180; 4,219,360; and 4,640,715 are incorporated herein in their entirety by reference recognizing that either all or a portion of the particulate cremated ash product is sized and added to these moldable materials to form the desired shaped object.

U.S. Pat. Nos. 2,055,706; 2,247,120; 2,576,565; 3,376,145; 3,423,217; 3,991,005; 4,371,484; 4,747,985 are incorporated herein in their entirety by reference and disclose various other methods of particulate moldable materials to which particulate ash product is added and blended to produce a moldable product. Some of these molded products need to be sintered to effect the permanent bonding of the particles in the moldable product.

In another embodiment, a wet ceramic mixture of 44 percent water by dry weight is blended with a 56 percent mixture consisting of 60 percent talc, 38 percent ball clay and 2 percent calcium carbonate to form a small moldable mixture of particulate moldable materials adapted for forming a molded object. A small amount of particulate ash product is added to this mixture to produce the final moldable product. Where necessary, the ash product is pulverized using known techniques to a size sufficient to blend adequately and compatibly with the moldable materials in the ceramic mixture.

The amount and proportion of the pulverized ash product to be added are within the skill of the art. Ash product is added to this ceramic mixture in an amount effective to maintain the mixture moldable and can be fired in accordance to acceptable known techniques. The idea is simply to incorporate this ash product directly into the moldable material to produce a structure heretofore unavailable for use.

In a further embodiment, a plaster composition having a designation of No. 1 includes pure gypsum. A portion of a particulate ash product is pulverized, sized and mixed with the No. 1 moldable product. The resultant product is then shaped and hardened to achieve the desired rigid memorial object.

In another specific embodiment, a porcelain product includes a mixture of china clay comprising kaolin, ball clay, flint, feldspar and a coloring material. Again, a portion of the particulate ash product is pulverized, sized and mixed with a porcelain moldable material as disclosed herein for the purpose of forming the shaped image desired for the memorial structure.

Once the mixture has been formed, the moldable product resulting therefrom is formed as an image having a shaped surface. The shaped object is then processed further to harden the object which then consists of permanently bonded particulate ash product and moldable materials. The moldable product may be dried, heated in a kiln, sintered, or subjected to whatever process necessary to effect the permanent bonding of the particles in the shaped image.

Based upon descriptive information received concerning the deceased, such as pictures, written descriptions and the like, the hardened shaped surface of the rigid image is inscribed with indicia descriptive of the identity of the living being. Where the living being is an animal such as a dog, cat, bird and the like, the image is shaped as the particular animal with the appropriate body markings to replicate the appearance of the deceased animal. Additional markings such as name, birth date and any other type of documentation related to the identity of the deceased can also be added by direct imprinting on the image or by addition of plaques or plates to further memorialize the identity of the deceased.

While the personalized pet animal memorial product has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A personalized pet animal memorial product produced from the ashes of a cremated pet animal, said product comprising:

(a) a shaped image of a deceased pet animal selected from the group consisting of a dog, a cat and a bird whose expired remains have been cremated to produce a resultant particulant ash product, (b) said shaped image being formed by mixing at least a portion of the particulate ash product with particulate moldable materials to form a moldable mixture and shaping the moldable material to produce a shaped surface in the form of the pet animal form from which the particulate ash product has been obtained in the cremation process, (c) the portion of the particulate ash of the cremated remains having been first pulverized to a size sufficient to adequately and compatibly blend into the mixture of said particulate multiple materials, and (d) means for permanently bonding the particulate ash products and moldable materials together within the mixture to fix the image with the shaped surface conforming to the shape of the deceased pet animal, (e) the shaped surface of the image including surface indicia descriptive of the identity of the personal pet animal including body markings which are shaped and disposed on the shaped surface to duplicate the appearance of the pet animal, (f) the surface indicia including means providing legible documentation of facts identifying the shaped image as a personalized replica of the deceased pet animal from which the particulate ash of its cremated remains are integrally formed within the shaped image.

* * * * *